US005995790A

United States Patent [19]

Takeda

[11] Patent Number: 5,995,790

[45] Date of Patent: Nov. 30, 1999

[54] DEVELOPING APPARATUS WITH DEVELOPER FEED REGULATOR

[75] Inventor: Ikuo Takeda, Kako-gun, Japan

[73] Assignee: Fujitsu Limited, Kawasaki, Japan

[21] Appl. No.: 09/118,012

[22] Filed: Jul. 17, 1998

[30] Foreign Application Priority Data

Jan. 30, 1998 [JP] Japan ..... 10-019032

[51] Int. Cl.[6] ..... G03G 15/09

[52] U.S. Cl. ..... 399/274; 399/269; 399/272; 399/273

[58] Field of Search ..... 399/265, 267, 399/269, 274, 279, 284, 273, 272

[56] References Cited

U.S. PATENT DOCUMENTS

| | | | |
|---|---|---|---|
| 4,063,533 | 12/1977 | White | 399/269 |
| 4,266,868 | 5/1981 | Bresina et al. | 399/269 |
| 4,493,882 | 1/1985 | Kaneko et al. | 430/122 X |
| 4,912,511 | 3/1990 | Murasaki | 399/269 |
| 5,516,982 | 5/1996 | Takeuchi et al. | 399/274 |
| 5,545,840 | 8/1996 | Doi et al. | 399/274 |
| 5,907,755 | 5/1999 | Takuma et al. | 399/269 X |

FOREIGN PATENT DOCUMENTS

| | | |
|---|---|---|
| 56-017367 | 2/1981 | Japan . |
| 57-122464 | 7/1982 | Japan . |

*Primary Examiner*—Matthew S. Smith
*Attorney, Agent, or Firm*—Armstrong, Westerman, Hattori, McLeland, & Naughton

[57] ABSTRACT

A developing apparatus is provided for incorporation into an image forming machine. The developing apparatus includes a developer accommodating space for containing a developer composition, a series of developing rollers disposed in the developer accommodating space adjacent to each other and in facing relationship to an electrostatic latent image carrier for supplying the developer composition to the image carrier while transferring the developer composition from one developing roller to another, and a developer feed regulator for regulating the transfer of the developer composition between adjacent two of the developing rollers.

19 Claims, 6 Drawing Sheets

DEVELOPING APPARATUS WITH DEVELOPER FEED REGULATOR

BACKGROUND OF THE INVENTION

1. Field of the Invention

The present invention relates to a developing apparatus which may be incorporated in an image forming machine such as an electrophotographic printer or electrostatic-recording printer. More specifically, the present invention relates to a developing apparatus of the type which includes two or more developing rollers.

2. Description of the Related Art

Recently, an electrophotographic printer is increasingly used which has a developing apparatus equipped with two or more developing rollers in order to meet a demand for higher printing speed. Such a developing apparatus effectively supplies a sufficient amount of developer composition to an electrostatic latent image carrier such as a photosensitive drum for development of the latent images, thereby enabling thick printing.

A developing apparatus of the above-described type is exemplified in FIG. 9. As shown in this figure, a photosensitive drum 10 rotates clockwise (the arrow P direction in FIG. 9). The drum 10 faces a first or lower developing roller 20 and a second or upper developing roller 30. Each of the developing rollers 20, 30 includes a magnetic roll body 21 (31) which is a fixed cylinder with N-poles and S-poles alternately arranged circumferential, and a rotary sleeve 22 (32) of e.g. stainless steel rotatably fitted on the roll body. The rotary sleeve 22 (32) rotates clockwise (the arrow P direction), preferably at a higher peripheral speed than the photosensitive drum 10.

Both of the developing rollers 20, 30 are disposed in a container 40 containing a suitable amount of developer composition S which is a mixture of toner with small magnetic particles as carrier. The toner is replenished as consumed, from a non-illustrated toner supplier, and thus the developer composition is maintained at a predetermined toner concentration. Indicated by reference numeral 41 is an agitator for helping the developer composition circulate within the container 40.

The developer composition S is electrostatically charged by mutual friction between the toner particles and the carrier particles while being agitated by the agitator 41. When moved onto the first developing roller 20 by the agitator 41, the developer composition is attracted on the rotary sleeve 22 by the magnetism of the magnetic roll body 21 and then supplied onto the photosensitive drum 10 as the rotary sleeve 22 rotates. Specifically, the developer composition on the rotary sleeve 22 ears up like whiskers along the magnetic flux arcuately extending from the N poles to the S poles around the magnetic roll body 21 and is transferred in this state. The ear-up state of the developer composition is appropriate for effectively depositing the developer composition on the photosensitive drum 10. At this time, the ear-up height of the developer composition is regulated by a first scraper or blade. 42 disposed under the first developing roller 20.

A remaining portion of the developer composition not passed onto the drum 10 is passed onto the second developing roller 30 and transferred thereon again in the ear-up state while coming into contact with the drum 10 for secondary deposition. A residual portion of the developer composition not passed onto the drum 10 even in the second chance for deposition moves with the rotation of the rotary sleeve 32, and is then scraped off the rotary sleeve 32 by a second scraper 43 to fall into the container 41 for recirculation.

As described hereinabove, during a single cycle of circulation within the container 40, the developer composition S comes into contact with the photosensitive drum 10 twice due to the provision of the two developing rollers 20, 30. Thus, even if the drum 10 and the developing rollers 20, 30 are rotated at a high speed for high speed printing, it is still possible to efficiently supply a sufficient amount of developer composition to the drum 10 for realizing appropriately thick printing.

However, the developing apparatus equipped with the plurality of developing rollers 20, 30 is still disadvantageous in that the carrier particles of the developer composition deteriorate in a relatively short time, and such carrier deterioration leads to a decrease of the developer composition supply to the photosensitive drum 10, consequently resulting in faint printing. This is because the circulating path for the developer composition within the container 40 is extended due to the provision of the two developing rollers 20, 30 instead of a single developing roller. In particular, the developer composition is subjected to great friction between the two rotary sleeves 22, 32 when transferred from the first developing roller 20 to the second developing roller 30. As a result, the toner powder deposits on the surfaces of the carrier particles, or the coating provided on the carrier particles is damaged, thereby resulting in improper and/or unstable electrostatic charge.

In this regard, it is possible to adjust the gray level of printing by controlling for example the charge voltage of the photosensitive drum 10. However, the early deterioration of the printing quality caused by the above-described carrier deterioration applies regardless of the gray level setting.

SUMMARY OF THE INVENTION

It is therefore an object of the present invention to provide a developing apparatus which incorporates a plurality of developing rollers and which is capable of maintaining a stable printing quality for a long time.

Another object of the present invention is to provide a developing apparatus which is capable of conveniently adjusting the toner thickness level or gray level of the printed image.

A further object of the present invention is to provide an image forming machine which incorporates such a developing apparatus.

According to a first aspect of the present invention, there is provided a developing apparatus for an image forming machine, the developing apparatus comprising: a developer accoimodating space for containing a developer composition; a series of developing rollers disposed in the developer accommodating space adjacent to each other and in facing relationship to an electrostatic latent image carrier for supplying the developer composition to the image carrier while transferring the developer composition from one developing roller to another; and a developer feed regulator for regulating the transfer of the developer composition between adjacent two of the developing rollers.

Preferably, the developer feed regulator may be rendered capable of switching between a first state for allowing the roller-to-roller transfer of the developer composition and a second state for regulating the roller-to-roller transfer of the developer composition. Alternatively or additionally, the developer feed regulator may be rendered capable of adjusting an extent of regulating the roller-to-roller transfer of the developer composition.

With the above arrangement of the developing apparatus, the supply of the developer composition from one developing roller (supplying-side developing roller) to another (receiving-side developing roller) can be interrupted or adjusted as necessary. Thus, it becomes possible to adjust the supply of the developer composition to the electrostatic latent image carrier via the developing rollers.

When the supply of the developer composition from one developing roller to another is stopped or reduced, a large portion of the developer composition circulates within the developer accommodating space while bypassing the receiving-side developing roller. Thus, the circulating path of the developer composition is virtually shortened, and the developer composition is less subjected to less friction with the receiving-side developing roller. As a result, it becomes possible to prolong the life of the carrier in the developer composition, thereby maintaining a stable printing quality for a long period of time.

According to a second aspect of the present invention, there is provided a developing apparatus for an image forming machine, the developing apparatus comprising: a developer accommodating space for containing a developer composition; a first developing roller disposed in the developer accommodating space and in facing relationship to an electrostatic latent image carrier for supplying the developer composition to the image carrier; a second developing roller disposed in the developer accommodating space adjacent to the first developing roller and in facing relationship to the electrostatic latent image carrier for receiving the developer composition from the first developing roller and for supplying the developer composition to the image carrier; and a developer feed regulator for regulating the transfer of the developer composition from the first developing roller to the second developing roller.

Again, the developer feed regulator may be rendered capable of switching between a first state for allowing the roller-to-roller transfer of the developer composition and a second state for regulating the roller-to-roller transfer of the developer composition. Alternatively or additionally, the developer feed regulator may be rendered capable of adjusting an extent of regulating the roller-to-roller transfer of the developer composition.

According to a preferred embodiment of the present invention, the second developing roller includes a magnetic roll body and a rotary sleeve rotatably fitted on the roll body. Further, the magnetic roll body has a circumferential surface having a magnetically stronger region and a magnetically weaker region, and the developer feed regulator comprises an actuator for selectively rotating the magnetic roll body between a feed position in which the magnetically weaker region is directed away from the image carrier and a feed regulating position in which the magnetically weaker region faces the first developing roller.

According to another preferred embodiment of the present invention, the second developing roller also includes a magnetic roll body and a rotary sleeve rotatably fitted on the roll body. Further, the developer feed regulator comprises means for selecting a feed state in which the rotary sleeve is driven for rotation in a forward direction and a feed regulating state in which the rotary sleeve is not driven for rotation in the forward direction. In this case, the rotary sleeve may be allowed to rotate freely in the feed regulating state. Alternatively, the rotary sleeve may be positively driven for rotation in a reverse direction in the feed regulating state.

According to a further embodiment of the present invention, the developer feed regulator comprises a partitioning member selectively movable between a feed position in which the partitioning member is brought out of a spacing between the first and second developing rollers and a feed regulating position in which the partitioning member inserted in the spacing.

According to still another ebbodiment of the present invention, the developer feed regulator comprises means for selectively moving the second developing roller toward and away from the first developing roller for varying a spacing between the first and second developing rollers.

According to a third aspect of the present invention, there is provided an image forming machine comprising an electrostatic latent image carrier, and a developing apparatus supplying a developer composition to the image carrier, the developing apparatus comprising: a developer accommodating space for containing a developer composition; a first developing roller disposed in the developer accommodating space and in facing relationship to the image carrier for supplying the developer composition to the image carrier; a second developing roller disposed in the developer accommodating space adjacent to the first developing roller and in facing relationship to the image carrier for receiving the developer composition from the first developing roller and for supplying the developer composition to the image carrier; and a developer feed regulator for regulating the transfer of the developer composition from the first developing roller to the second developing roller.

Other features and advantages of the present invention should become clear from the detailed description to be made hereinafter referring to the accoenanied drawings.

DETAILED DESCRIPTION OF THE PREFERRED EMBODIMENTS

Figure 9:
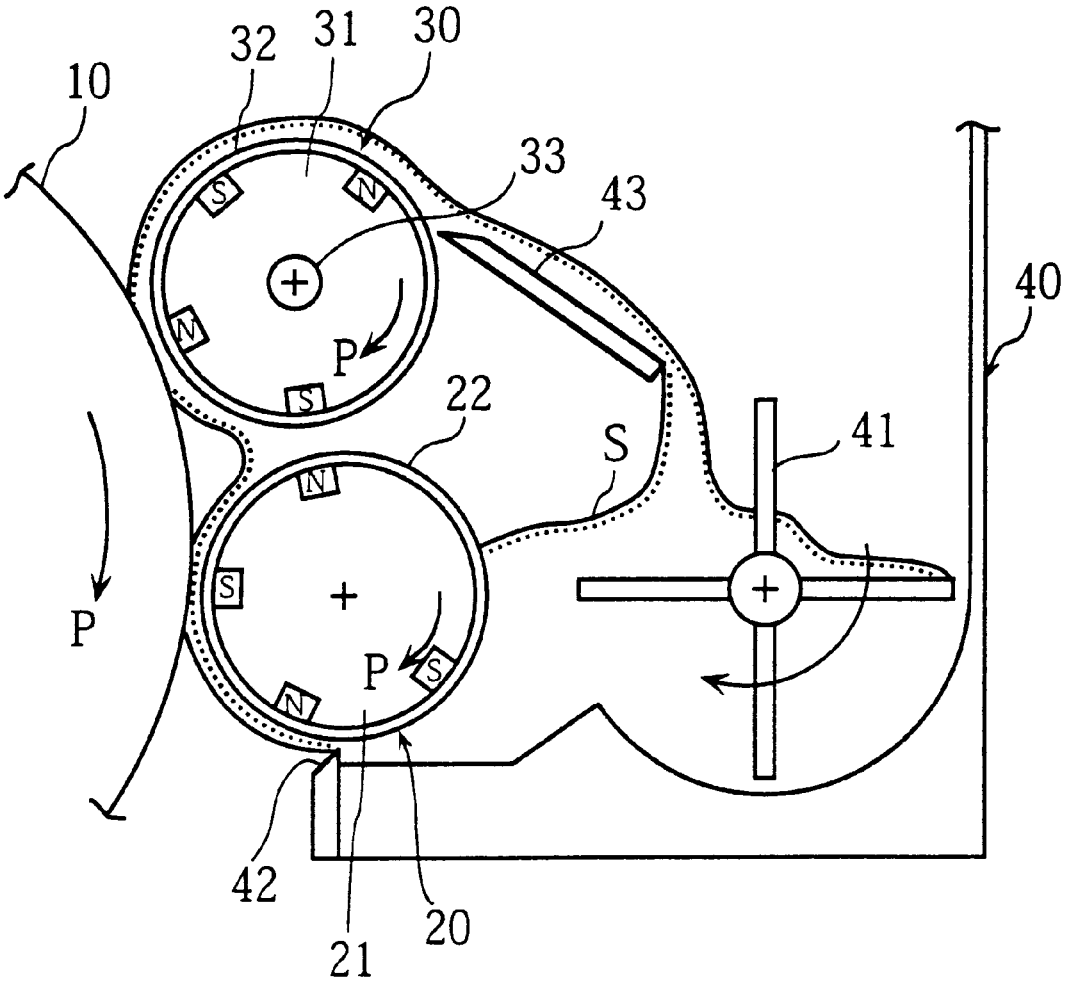
FIG. 9 Prior Art
FIG. 9 is a schematic side view showing a prior art developing apparatus.

The preferred embodiments of the present invention will be specifically described below with reference to the accompanying drawings. In FIGS. 1 through 8 of the drawings, elements of the preferred embodiments identical or similar to those of the prior art apparatus shown in FIG. 9 are designated by the same reference signs as those used for the prior art apparatus.

Figure 1:
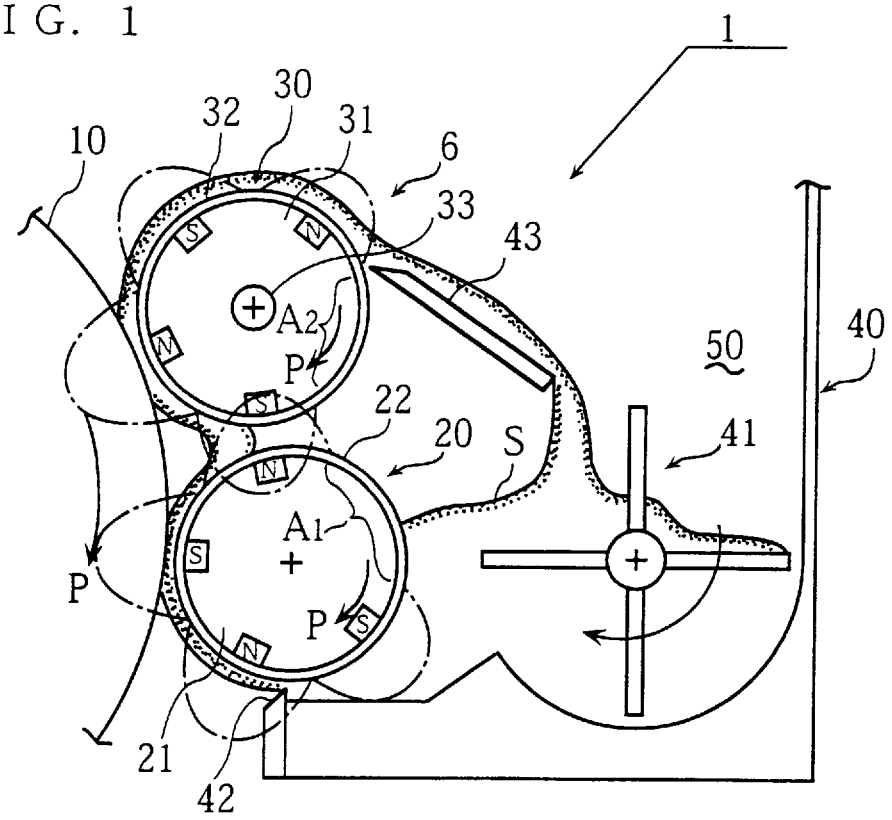
FIG. 1 is a schematic side view showing a developing apparatus according to a first embodiment of the present invention in a feed mode.
Figure 2:
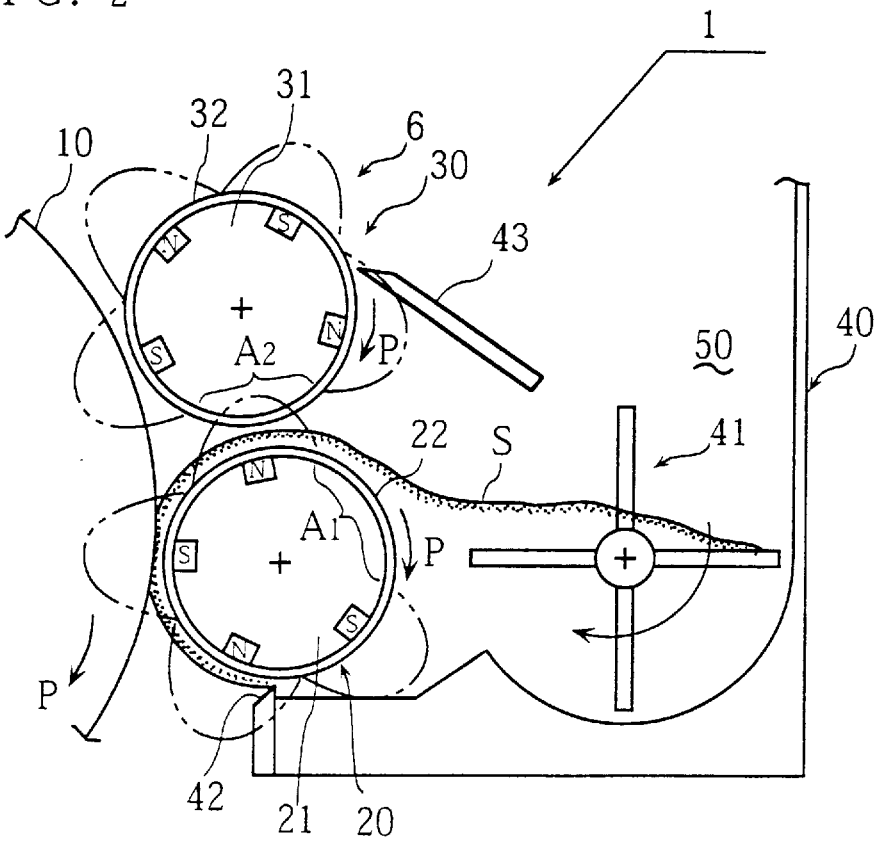
FIG. 2 is a schematic side view showing the same developing apparatus in a feed regulating mode.

FIGS. 1 and 2 schematically show a developing apparatus 1 according to a first emboient of the present invention. A photosensitive drum 10 as an electrostatic latent image carrier is supported for clockwise rotation (the arrow P direction in FIGS. 1 and 2). The circumferential wall of the drum 10 faces two developing rollers 20, 30 (a first developing roller 20 and a second developing roller 30) disposed one above the other adjacent to each other. The two developing rollers 20, 30 are placed in a developer accommodating space 50 defined by the circumferential wall of the photosensitive drum 10 and the walls of a container 40. The developer receiving space 50 holds a powdery developer composition S containing toner mixed with minute magnetic particles as a carrier. The toner is replenished as consumed from e.g. a toner cartridge placed above the container 40 so that the developer composition is maintained at a predetermined toner concentration. A rotary-blade type agitator 41 is arranged behind the developing rollers 20, 30 within the container 40. The agitator 41 rotates clockwise in FIGS. 1 and 2 for agitating and feeding the developer composition S to the developing rollers 20, 30.

The developing rollers 20, 30 pick up the developer composition S from the bottom of the container 40 and retain it on their respective circumferential surfaces by magnetism. The developer composition thus picked up is fed onto the circumferential surface of the photosensitive drum 10 for developing the latent images carried thereon.

Each of the developing rollers 20, 30 includes a cylindrical magnetic roll body 21 (31) having N-poles and S-poles alternately arranged at its circumferential surface, and a rotary sleeve 22 (32) made of aluminum for example. The magnetic poles are disposed primarily in a circumferential portion of the roll body 21 (31) closer to the photosensitive drum 10 (as required for feeding the developer composition to the drum 10), whereas no magnet is disposed in the remaining circumferential portion of the roll body 21 (31) directed away from the drum 10. As a result, the developing roller 21 (31) has a magnetically weaker region Al (A2) in addition to a magnetically stronger region. For reference, the magnetic flux distribution around the developing roller 20 (30) is schematically indicated by phantom lines in FIGS. 1 and 2.

The magnetic roll body 21 of the first or lower developing roller 20 is rotationally fixed. Therefore, the rotary sleeve 22 alone is rotatable clockwise (the arrow P direction in FIGS. 1 and 2). Preferably, the rotary sleeve 22 may be rotated to have a higher peripheral speed-than the photosensitive drum 10.

On the other hand, the magnetic roll body 31 of the second or upper developing roller 30 is reciprocatively rotatable within a predetermined angular range for constituting a part of a developer feed regulator 6, as described hereinafter. Like the rotary sleeve 22 of the first developing roller 20, the rotary sleeve 32 of the second developing roller 30 is also rotatable clockwise (in the arrow P direction). Again, this rotary sleeve 32 may preferably be rotated to have a higher peripheral speed than the photosensitive drum 10.

The rotary sleeve 22 of the first developing roller 20 is downwardly adjoined by a first scraper 42 for limiting the rising height of the developer composition S attracted onto the first developing roller 20. Further, the rotary sleeve 32 of the second developing roller 30 is rearwardly adjoined by a second scraper 43 for scraping a residual portion (non-transferred portion) of the developer composition S off the second roller 30.

The developer feed regulator 6 is capable of adjusting the feed of developer composition S from the first developing roller 20 to the second developing roller 30. According to the first embodiment of the present embodiment, the adjusting function of the developer feed regulator 6 is provided by the reciprocative rotatability of the magnetic roll body 31 of the second developing roller 30. More specifically, the magnetic roll body 31 of the second developing roller 30 is selectively rotatable between a feed position (FIG. 1) in which the magnetically weaker region A2 of the roll body 31 is directed away from the photosensitive roller 10, and a feed regulating position (FIG. 2) in which the magnetically weaker region A2 is directed toward the first developing roller 20. Further, the magnetic roll body 31 may additionally assume any intermediate position between the feed position and the feed regulating position.

The developing apparatus 1 having the above-described structure operates in the following manner.

In the normal operation mode (FIG. 1) where the magnetic roll body 31 of the second developing roller 30 assumes the feed position shown in FIG. 1, the magnetically weaker region A2 of the roll body 31 is directed away from the photosensitive drum 10, so that the roll body 31 generates a sufficiently strong magnetic field directed toward the first developing roller 20 and the photosensitive drum 10. In this condition, the developer composition S is first attracted on the circumferential surface of the rotary sleeve 22, in rotation, of the first developing roller 20 for partial feeding to the photosensitive drum 10. A remaining portion of the developer composition S not yet transferred onto the drum 10 continues to move with the rotary sleeve 22, and then passed to the rotary sleeve 32 of the second developing roller 30. Just like the first developing roller 20, the second developing roller 30 feeds a further portion of the attracted developer composition S to the photosensitive drum 10 as the rotary sleeve 32 rotates. A residual portion of the developer composition not transferred onto the drum 10 moves with the rotary sleeve 32 to be scraped off by the scraper 43 for recirculation.

In the above-described normal operation mode, the developer composition S is supplied twice to the photosensitive drum 10 by the first and second developing rollers 20, 30, respectively. Thus, it is possible to supply a sufficient amount of developer composition for performing dark printing.

In the feed regulating mode or toner-save mode shown in FIG. 2, on the other hand, the magnetically weaker region A2 of the magnetic roll body 31 of the second developing roller 30 is directed toward the first developing roller 20, so that the second developing roller 30 cannot receive a sufficient amount of the developer composition S from the first developing roller 20. Thus, in this operation mode, the photosensitive drum 10 is supplied with the developer composition S primarily by the first developing roller 20. In comparison with the normal operation mode shown in FIG. 1, a less amount of the developer composition is supplied to the photosensitive drum 10, consequently resulting in thinner printing. However, the life of the carrier (magnetic particles) in the developer composition S is extended because the developer composition now moves along a shorter circulation path and is therefore subjected to less friction with the second developing roller 30. It should be noted here that, in the feed regulating mode shown in FIG. 2, the rotary sleeve 32 of the second developing roller 30 may or may not be rotated.

According to the first embodiment, further, the magnetic roll body 31 of the second developing roller 30 may also assume any intermediate position between the feed position of FIG. 1 and the feed regulating positionofFig. 2. Thus, itispossibletosteplesslyadjusttheamount of developer composition S supplied to the photosensitive drum 10.

The rotary sleeves 22, 32 of the first and second developing rollers 20, 30 may be respectively driven by using a known mechanism such as an electric motor (as a drive source), and a combination of belt and pulleys (as a transmission).

Figure 3:
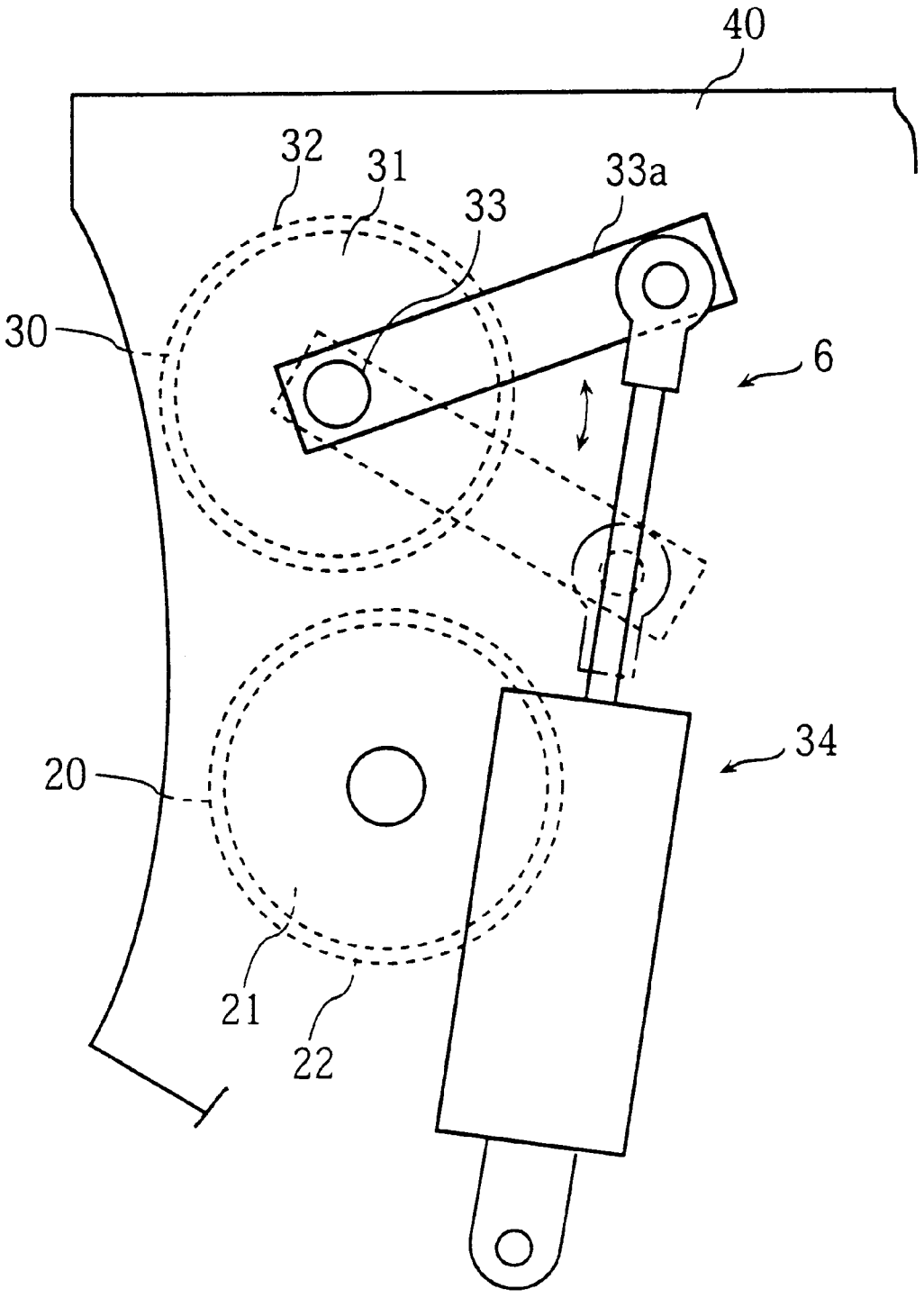
FIG. 3 is a schematic side view showing an actuator for a developer feed regulator of the same developing apparatus.

FIG. 3 shows an exemplary mechanism for reciprocatively rotating the magnetic roll body 31 of the second developing roller 30. Specifically, the reciprocative rotating mechanism includes a support shaft 33 of the roll body 31 rotatably supported on the container 40 (or support brackets), and an actuator 34 connected to an end of the support shaft 33 for causing reciprocative rotation thereof. The actuator 34 may include a linear solenoid pivotally connected to an crank arm 33*a* which in turn is pivotally connected to the support shaft 33, as shown in FIG. 3. Alternatively, the actuator may be a rotational solenoid directly connected to the support shaft 33.

Figure 4:
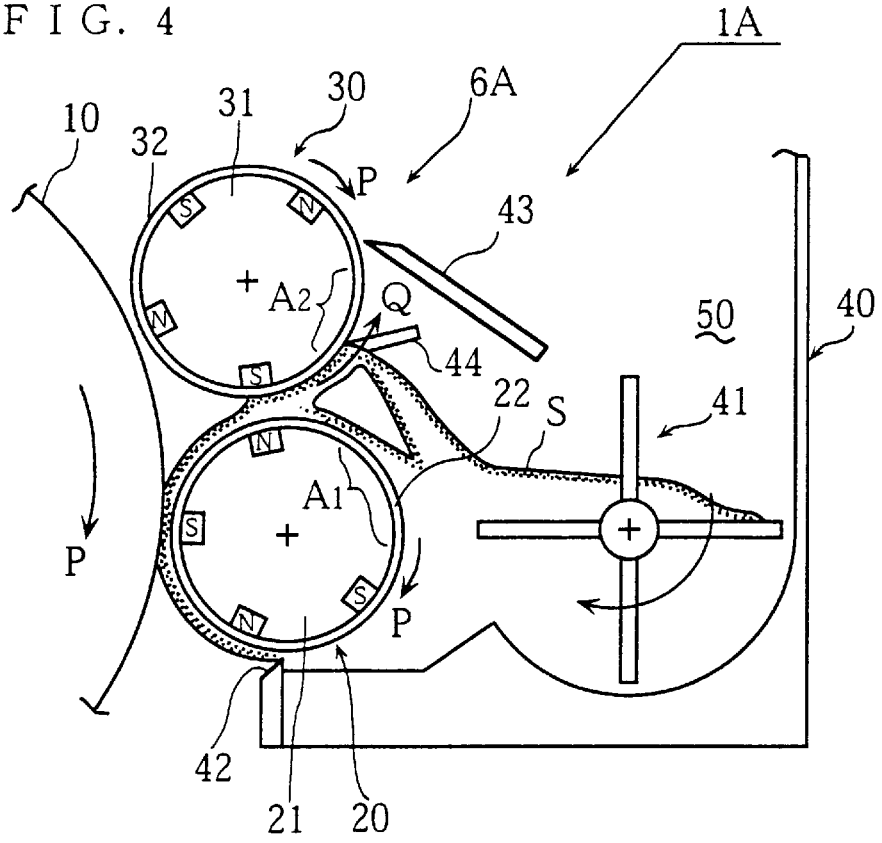
FIG. 4 is a schematic side view showing a developing apparatus according to a second embodiment of the present invention in a feed regulating mode.

FIG. 4 schematically shows a developing apparatus 1A according to a second embodiment of the present invention. The developing apparatus 1A of the second embodiment is similar to that of the first embodiment but differs therefrom only with respect to a developer feed regulator 6A.

The developer feed regulator 6A of the second embodiment is provided solely by the rotary sleeve 32 of the second developing roller 30. Specifically, the magnetic roll body 31 of the second developing roller 30 is rotationally fixed, but the rotary sleeve 32 is selectively switched between a feed state (feed state) wherein the sleeve 32 rotates in a forward or feed direction (the arrow P direction in FIG. 4), and a feed regulating state wherein the sleeve 32 does not rotate in the feed direction. In the feed regulating state, the rotary sleeve 32 may be allowed to turn freely in a reverse or feed regulating direction (the arrow Q direction in FIG. 4). Alternatively, the rotary sleeve 32 may be positively driven to turn in the reverse direction. Switching between the forward driving mode and the free turning mode may be achieved by providing a clutch mechanism (not shown) for the shaft of the rotary sleeve 32. On the other hand, switching between the forward driving mode and the reverse driving mode may be achieved by providing a reversible drive source (not shown) for reversibly rotating the rotary sleeve 32 or a reversible gear train (not shown) for reversibly transmitting the driving force of a one-way drive source (not shown) to the rotary sleeve 32.

The developing apparatus 1A of the second embodiment operates in the same manner as that of the first emoient (see FIG. 1) when the rotary sleeve 32 of the second developing roller 30 rotates in the forward or feed direction in the normal operation mode. In this mode, therefore, both of the first and second developing rollers 20, 30 effectively feed the developer composition S to the photosensitive drum 10 for realizing dark or thick printing.

On the other hand, when the rotary sleeve 32 of the second developing roller 30 is held in its state for free rotation in the feed regulating mode, the rotary sleeve 32 tends to rotate in the reverse or counterclockwise direction (as indicated by the arrow Q in FIG. 4) following the clockwise rotation of the rotary sleeve 22 of the first developing roller 20 (as indicated by the arrow P in FIG. 4). As a result, the developer composition S is guided to pass between the first developing roller 20 and the second developing roller 30.

At this time, if the rotary sleeve 32 has a high rotational resistance, the developer composition S may unexpectedly stagnate between the two developing rollers 20, 30. Such a problem can be avoided by positively driving the rotary sleeve 32 in the reverse direction.

Further, the rotary sleeve 32 rotating in the reverse direction may attract the developer composition S due to the magnetism from the magnetic roll body 31. However, due to the presence of the magnetically weaker region A2 of the magnetic roll body 32 directed away from the photosensitive drum 10, the developer composition S attracted on the rotary sleeve 32 is allowed to fall off in the magnetically weaker region A2 of the roll body 32, and therefore does not reach the photosensitive drum 10. Preferably, a scraper 44 may be provided for positively removing the developer composition S off the rotary sleeve 32 during the reverse rotation.

According to the second embodent described above, when the rotary sleeve 32 of the second developing roller 30 is held in the feed regulating state, the second developing roller 30 does not contribute to the supply of the developer composition S to the photosensitive drum 10. As a result, the amount of the developer composition S supplied to the photosensitive drum 10 becomes less in the feed regulating mode than in the normal mode where the rotary sleeve 32 rotates in the forward direction (the arrow P direction in FIG. 4).

Figure 5:
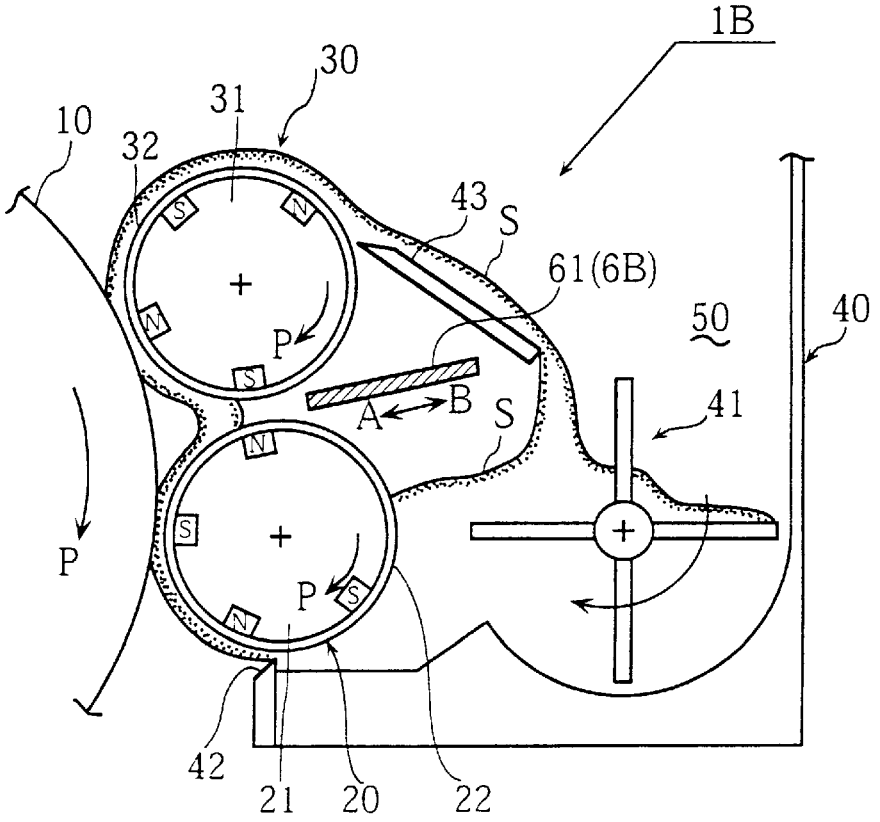
FIG. 5 is a schematic side view showing a developing apparatus according to a third embodiment of the present invention in a feed mode.
Figure 6:
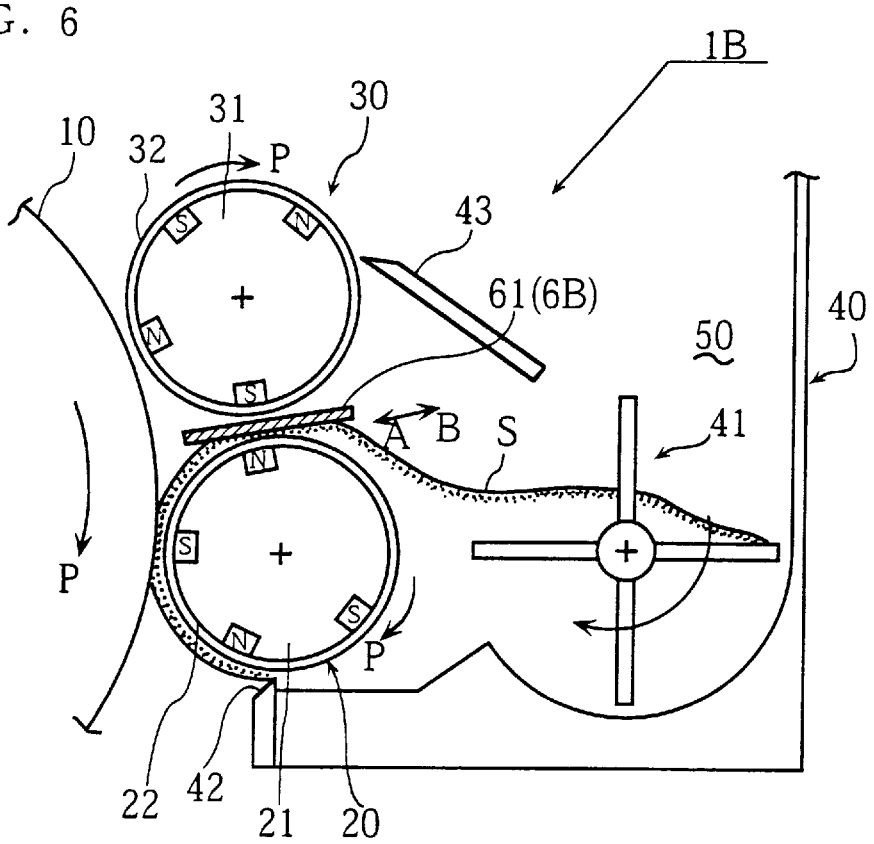
FIG. 6 is a schematic side view showing the developing apparatus of FIG. 5 in a feed regulating mode.

FIGS. 5 and 6 schematically show a developing apparatus 1B according to a third embodiment of the present invention. Again, the developing apparatus 1B of the third emodiment is similar to that of the first embodiment but differs therefrom only with respect to a developer feed regulator 6B.

In the third embodiment, the developer feed regulator 6 comprises a partitioning member 61 which is selectively movable between a feed position (FIG. 5) and a feed regulating position (FIG. 6). The partitioning member 61 in the feed position is retreated from the space formed between the two developing rollers 20, 30, whereas the feed regulating position is the position where the partitioning member 61 is inserted into the space between the two developing rollers 20, 30. Preferably, the partitioning member 61, which may be made of a stainless steel plate, is slidably supported at both ends on the container 40 or other brackets for movement toward and away from the space between the two rollers 20, 30, as indicated by the arrows A and B in FIGS. 5 and 6. The sliding movement of the partitioning member 61 may be realized by a linear solenoid (not shown) for example. of course, the partitioning plate 61 may be made to assume any intermediate position between the feed position and the feed regulating position.

The developing apparatus 1B of the third embodiment operates in the same manner as that of the first embodiment (see FIG. 1) when the partitioning member 61 assumes the feed position of FIG. 5 in the normal operation mode. In this mode, therefore, both of the first and second developing rollers 20, 30 effectively feed the developer composition S to the photosensitive drum 10 for realizing dark or thick printing.

On the other hand, when the partitioning member 61 assumes the feed regulating position for insertion between the first developing roller 20 and the second developing roller 30 (see FIG. 6), the partitioning member 61 prevents the developer composition S from transferring from the first developing roller 20 to the second developing roller 30. Thus, only the first developing roller 20 contributes to the supply of developer composition to the photosensitive drum 10, thereby reducing the amount of developer composition S supplied to the photosensitive drum 10. Further, it is also possible to vary the degree of insertion of the partitioning member 61 in between the two developing rollers 20, 30 for adjusting the amount of developer composition S transferred from the first developing roller 20 to the second developing roller 30, thereby steplessly adjusting the amount of developer composition S supplied to the photosensitive drum 10.

Figure 7:
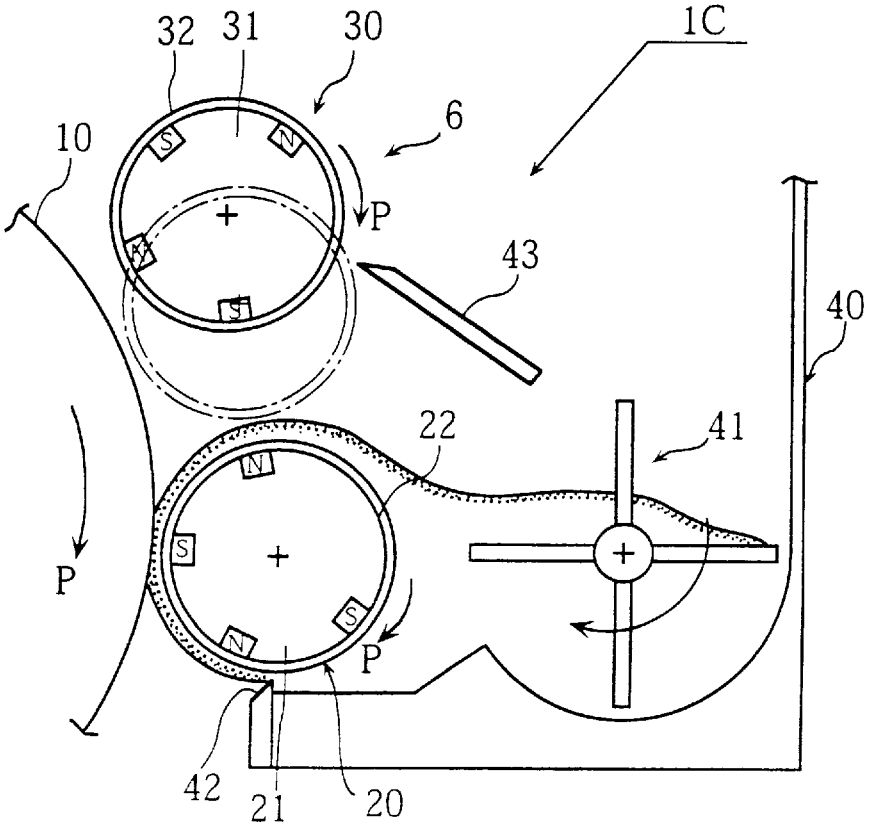
FIG. 7 is a schematic side view showing a developing apparatus according to a fourth embodiment of the present invention in a feed regulating mode.
Figure 8:
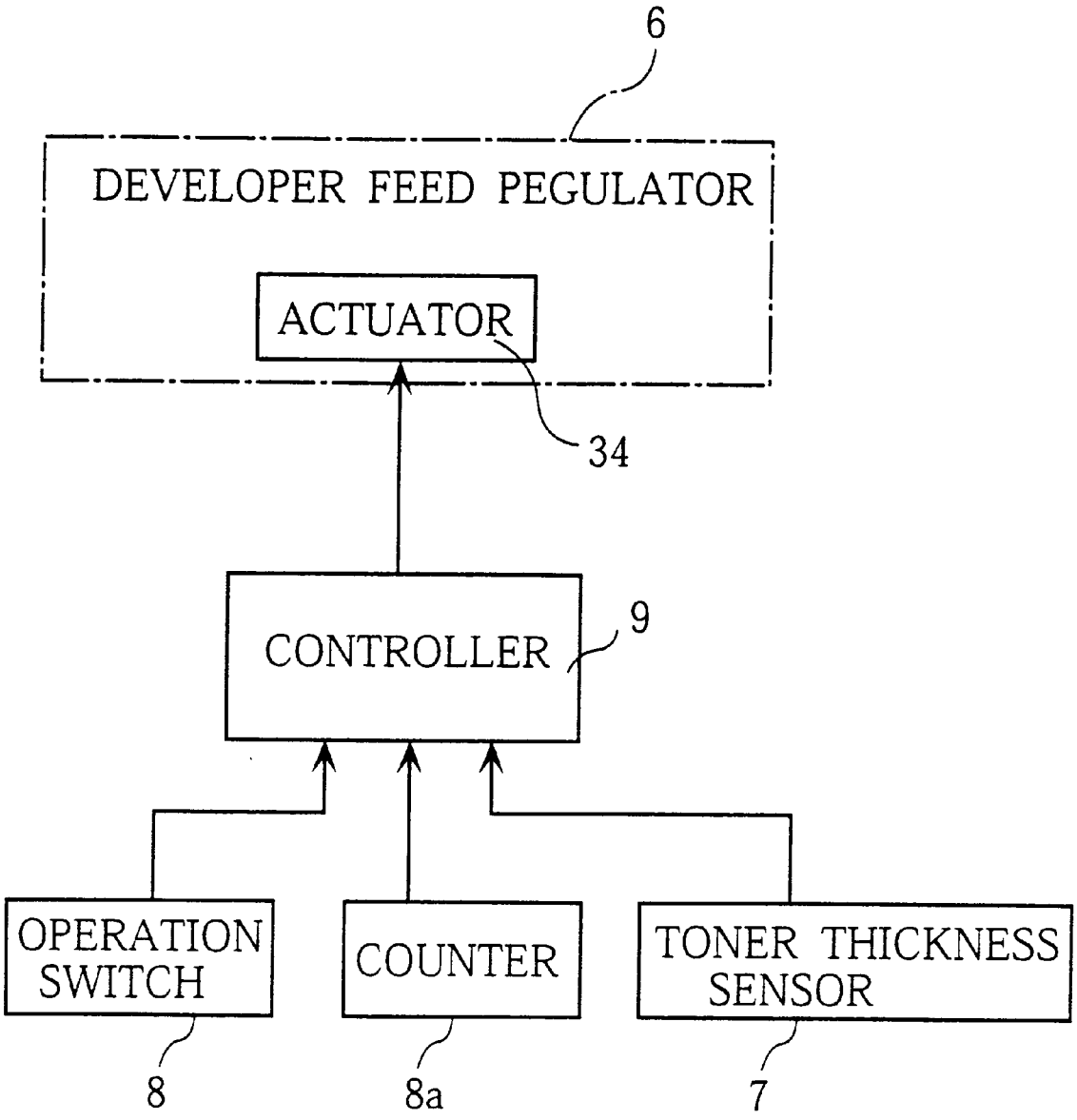
FIG. 8 is a block diagram showing examples of the developing apparatus in each of the embodiments.

FIG. 7 schematically shows a developing apparatus 1C according to a fourth embodiment of the present invention.

Again, the developing apparatus 1B of the third embodiment is similar to that of the first embodiment but differs therefrom only with respect to a developer feed regulator 6B.

In the fourth embodiment, the feed regulating function of the developer feed regulator 6 is provided by adjustability of the spacing between the first developing roller 20 and the second developing roller 30. For this purpose, brackets or any other support (not shown) for the second developing roller 30 may be preferably rendered vertically movable by means of an actuator (not shown), so that the second developing roller 30 can selectively assume a feed position (the phantom line position in FIG. 7) adjacent to the first developing roller 20 and a feed regulating position (the solid line position in FIG. 7) away from the first developing roller 20.

The developing apparatus 1C of the fourth embodiment operates in the same manner as that of the first embodiment (see FIG. 1) when the second developing roller 30 assumes the feed position close to the first developing roller 20 in the normal operation mode. In this mode, therefore, both of the first and second developing rollers 20, 30 effectively feed the developer composition S to the photosensitive drum 10 for realizing dark or thick printing.

On the other hand, when the second developing roller 30 assumes the feed regulating position away from the first developing roller 20 in the feed regulating mode, the second developing roller 30 cannot receive the developer composition S from the first developing roller 20. As a result, the supply of the developer composition S to the photosensitive drum 10 is performed primarily by the first developing roller 20 alone, so the amount of developer composition S supplied to the drum 10 reduces. Of course, the amount of developer composition S transferred from the first developing roller 20 to the second developing roller 30 may be adjusted by steplessly varying the spacing the first developing roller 20 and the second developing roller 30, and by doing so, the amount of developer composition S supplied to the photosensitive drum lo can be steplessly adjusted.

Any of the developing apparatuses 1, 1A, 1B, 1C according to the first to fourth embodiments may be incorporated in an electrophotographic or electrostatic image forming machine. Further, the developer feed regulator 6 (6A or 6B or 6C) of each developing apparatus 1 (1A or 1B or 1C) makes it possible to interrupt and/or adjust the transfer of the developer composition S from the first developing roller 20 to the second developing roller 30, as required. Thus, it becomes possible to control the supply of the developer composition S to the photosensitive drum 10.

When the transfer of the developer composition S to the second developing roller 30 is stopped or reduced, most of the developer composition S circulates within the developer accommodating space 50 while bypassing the second developing roller 30. In this state, the developer composition S circulates along a shorter path, and is less subjected to friction with thesecond developing roller 30. As a result, the life of the carrier in the developer composition S is extended for stabilizing the printing quality for a long time.

The developing apparatus 1 (1A or 1B or 1C) according to any one of the first to fourth embodiments may be conveniently used in various ways, as follows.

In a first example of use, an operation switch 8 (see FIG. 8) may be provided to select a toner save mode or a test print mode in addition to a normal print mode. When the toner save mode or the test print mode is selected by operating the operation switch 8, a controller 9 causes the actuator 34 to bring the developer feed regulator 6 (see the first embodiment shown in FIGS. 1 through 3) to the feed regulating position for interrupting or reducing the supply of the developer composition to the second developing roller 30. In this operation mode, the toner thickness lowers in forming images, but the toner consumption is reduced and the life of the carrier is prolonged.

In a second example of use, a counter 8*a* (see also FIG. 8) may be provided for counting the accumulated operation time or the accumulated number of printed pages. The accumulated value of the counter 8a may be utilized to control the actuator 34 through the controller 9 for progressively reducing the degree of developer feed regulation. For instance, only the first developing roller 20 is used to supply the developer composition S to the photosensitive drum 10 in an initial stage. As the carrier in the developer composition S deteriorates with the progress of the printing time, the developer composition is supplied not only by the first developing roller 20 but also by the second developing roller 30 for progressively increasing the amount of developer composition supplied to the photosensitive drum 10. The deterioration of the carrier continues with the accumulated operation time of the image forming unit, making the printed image increasingly faint. However, according to this mode of use, the increasing tendency toward fainter printing can be compensated for by the increasing supply of the developer composition by the second developing roller 30. Thus, the quality of printing can be stabilized.

In a third example of use, the capability of the developer feed regulator 6 (6A or 6B or 6C) to adjust the amount of developer composition S supplied to the photosensitive drum 10 can be utilized as a means for adjusting the gray level of the printed image. Typically, the gray level adjustment in an image forming machine is provided by controlling the charge voltage of the photosensitive drum for example. The capability of the developing apparatus to adjust the supply of developer composition according to the present invention can additionally utilized for expanding the realizable range of gray level adjustment.

In a fourth example of use which is similar to the second use example described above, a toner thickness sensor 7 (see FIG. 8) is provided for detecting the toner thickness on the photosensitive drum 10. The toner thickness detected by the toner thickness sensor 7 may be utilized to control the actuator 34 through the controller 9 for progressively reducing the degree of developer feed regulation. For instance, only the first developing roller 20 is used to supply the developer composition S to the photosensitive drum 10 in an initial stage. As the toner thickness on the drum 10 decreases, the developer composition is supplied not only by the first developing roller 20 but also by the second developing roller 30 for progressively increasing the amount of developer composition supplied to the photosensitive drum 10. According to this mode of use, the increasing tendency toward fainter printing can be compensated for by the increasing supply of the developer composition by the second developing roller 30. Thus, the quality of printing can be stabilized.

The scope of the present invention is not limited to the preferred embodiments so far described. For example, the photosensitive drum 10 as an electrostatic latent image carrier used in each of the embodiments may be replaced by an endless belt type photosensitive member.

Further, one or more developing rollers may be provided in addition to the two developing rollers 20, 30. In this case, a developer feed regulator may be arranged for any adjacent two of the developing rollers.

The preferred embodiments of the present invention being thus described, it is obvious that the same may be varied in various way. Such variations should not be regarded as a departure from the spirit and scope of the invention, and all such variations as would be obvious to those skilled in the art are intended to be included within the scope of the appended claims.

I claim:

1. A developing apparatus for an image forming machine, the developing apparatus comprising:

a developer accommodating space containing a developer composition;

a series of developing rollers disposed in the developer accommodating space adjacent to each other and in facing relationship to an electrostatic latent image carrier, the developing rollers supplying the developer composition to the image carrier while performing a roller-to-roller transfer of the developer composition from one developing roller to another; and a developer feed regulator selectively stopping the transfer of the developer composition between adjacent two of the developing rollers.

2. The developing apparatus according to claim 1, wherein the developer feed regulator is capable of switching between a first state allowing the roller-to-roller transfer of the developer composition and a second state stopping the roller-to-roller transfer of the developer composition.

3. The developing apparatus according to claim 1, wherein the developer feed regulator is capable of adjusting an extent of the roller-to-roller transfer of the developer composition.

4. A developing apparatus for an image forming machine, the developing apparatus comprising:

a developer accommodating space containing a developer composition;

a first developing roller disposed in the developer accommodating space and in facing relationship to an electrostatic latent image carrier, the first developing roller supplying the developer composition to the image carrier;

a second developing roller disposed in the developer accommodating space adjacent to the first developing roller and in facing relationship to the electrostatic latent image carrier, the second developing roller receiving the developer composition from the first developing roller and supplying the developer composition to the image carrier; and a developer feed regulator selectively stopping a roller-to-roller transfer of the developer composition from the first developing roller to the second developing roller.

5. The developing apparatus according to claim 4, wherein the developer feed regulator is capable of switching between a first state allowing the roller-to-roller transfer of the developer composition and a second state stopping the roller-to-roller transfer of the developer composition.

6. The developing apparatus according to claim 4, wherein the developer feed regulator is capable of adjusting an extent of the roller-to-roller transfer of the developer composition.

7. A developing apparatus for an image forming machine, the developing apparatus comprising:

a developer accommodating space containing a developer composition;

a first developing roller disposed in the developer accommodating space and in facing relationship to an electrostatic latent image carrier, the first developing roller supplying the developer composition to the image carrier;

a second developing roller disposed in the developer accommodating space adjacent to the first developing roller and in facing relationship to the electrostatic latent image carrier, the second developing roller receiving the developer composition from the first developing roller and supplying the developer composition to the image carrier. the second developing roller includes a magnetic roll body and a rotary sleeve rotatably fitted on the roll body, the magnetic roll body having a circumferential surface having a magnetically stronger region and a magnetically weaker region; and a developer feed regulator comprising an actuator selectively rotating the magnetic roll body between a feed position in which the magnetically weaker region is directed away from the image carrier and a feed regulating position in which the magnetically weaker region faces the first developing roller.

8. A developing apparatus for an image forming machine, the developing apparatus comprising:

a developer accommodating space containing a developer composition;

a first developing roller disposed in the developer accommodating space and in facing relationship to an electrostatic latent image carrier, the first developing roller supplying the developer composition to the image carrier;

a second developing roller disposed in the developer accommodating space adjacent to the first developing roller and in facing relationship to the electrostatic latent image carrier, the second developing roller receiving the developer composition from the first developing roller and supplying the developer composition to the image carrier, the second developing roller includes a magnetic roll body and a rotary sleeve rotatably fitted on the roll body; and a developer feed regulator comprising means for selecting a feed state in which the rotary sleeve is driven for rotation in a forward direction and a feed regulating state in which the rotary sleeve is not driven for rotation in the forward direction.

9. The developing apparatus according to claim 8, wherein the rotary sleeve is allowed to rotate freely in the feed regulating state.

10. The developing apparatus according to claim 8, wherein the rotary sleeve is positively driven for rotation in a reverse direction in the feed regulating state.

11. A developing apparatus for an image forming machine, the developing apparatus comprising:

a developer accommodating space containing a developer composition;

a first developing roller disposed in the developer accommodating space and in facing relationship to an electrostatic latent image carrier, the first developing roller supplying the developer composition to the image carrier;

a second developing roller disposed in the developer accommodating space adjacent to the first developing roller and in facing relationship to the electrostatic latent image carrier, the second developing roller receiving the developer composition from the first developing roller and supplying the developer composition to the image carrier; and a developer feed regulator comprises a partitioning member selectively movable between a feed position in which the partitioning member is brought out of a spacing between the first and second developing rollers and a feed regulating position in which the partitioning member is inserted in the spacing.

12. A developing apparatus for an image forming machine, the developing apparatus comprising:

a developer accommodating space containing a developer composition:

a first developing roller disposed in the developer accommodating space and in facing relationship to an electrostatic latent image carrier, the first developing roller supplying the developer composition to the image carrier;

a second developing roller disposed in the developer accommodating space adjacent to the first developing roller and in facing relationship to the electrostatic latent image carrier, the second developing roller receiving the developer composition from the first developing roller and supplying the developer composition to the image carrier; and a developer feed regulator comprises means for selectively moving the second developing roller toward and away from the first developing roller for varying a spacing between the first and second developing rollers.

13. An image forming machine comprising an electrostatic latent image carrier, and a developing apparatus supplying a developer composition to the image carrier, the developing apparatus comprising:

a developer accommodating space containing a developer composition;

a first developing roller disposed in the developer accommodating space and in facing relationship to the image carrier, the first developing roller supplying the developer composition to the image carrier;

a second developing roller disposed in the developer accommodating space adjacent to the first developing roller and in facing relationship to the image carrier, the second developing roller receiving the developer composition from the first developing roller and supplying the developer composition to the image carrier; and a developer feed regulator selectively stopping a roller-to-roller transfer of the developer composition from the first developing roller to the second developing roller.

14. An image forming machine comprising an electrostatic latent image carrier, and a developing apparatus supplying a developer composition to the image carrier, the developing apparatus comprising:

a developer accommodating space containing a developer composition;

a first developing roller disposed in the developer accommodating space and in facing relationship to the image carrier, the first developing roller supplying the developer composition to the image carrier;

a second developing roller disposed in the developer accommodating space adjacent to the first developing roller and in facing relationship to the image carrier, the second developing roller receiving the developer composition from the first developing roller and supplying the developer composition to the image carrier, the second developing roller includes a magnetic roll body and a rotary sleeve rotatably fitted on the roll body, the magnetic roll body having a circumferential surface having a magnetically stronger region and a magnetically weaker region; and a developer feed regulator comprising an actuator selectively rotating the magnetic roll body between a feed position in which the magnetically weaker region is directed away from the image carrier and a feed regulating position in which the magnetically weaker region faces the first developing roller.

15. An image forming machine comprising an electrostatic latent image carrier, and a developing apparatus supplying a developer composition to the image carrier, the developing apparatus comprising:

a developer accommodating space containing a developer composition;

a first developing roller disposed in the developer accommodating space and in facing relationship to the image carrier. the first developing roller supplying the developer composition to the image carrier;

a second developing roller disposed in the developer accommodating space adjacent to the first developing roller and in facing relationship to the image carrier, the second developing roller receiving the developer composition from the first developing roller and supplying the developer composition to the image carrier, the second developing roller includes a magnetic roll body and a rotary sleeve rotatably fitted on the roll body; and a developer feed regulator comprising means for selecting a feed state in which the rotary sleeve is driven for rotation in a forward direction and a feed regulating state in which the rotary sleeve is not driven for rotation in the forward direction.

16. The image forming machine according to claim 15, wherein the rotary sleeve is allowed to rotate freely in the feed regulating state.

17. The image forming machine according to claim 15, wherein the rotary sleeve is positively driven for rotation in a reverse direction in the feed regulating state.

18. An image forming machine comprising an electrostatic latent image carrier, and a developing apparatus supplying a developer composition to the image carrier, the developing apparatus comprising:

a developer accommodating space containing a developer composition;

a first developing roller disposed in the developer accommodating space and in facing relationship to the image carrier, the first developing roller supplying the developer composition to the image carrier;

a second developing roller disposed in the developer accommodating space adjacent to the first developing roller and in facing relationship to the image carrier, the second developing roller receiving the developer composition from the first developing roller and supplying the developer composition to the image carrier; and a developer feed regulator comprises a partitioning member selectively movable between a feed position in which the partitioning member is brought out of a spacing between the first and second developing rollers and a feed regulating position in which the partitioning member is inserted in the spacing.

19. An image forming machine comprising an electrostatic latent image carrier, and a developing apparatus supplying a developer composition to the image carrier, the developing apparatus comprising:

a developer accommodating space containing a developer composition;

a first developing roller disposed in the developer accommodating space and in facing relationship to the image carrier, the first developing roller supplying the developer composition to the image carrier;

a second developing roller disposed in the developer accommodating space adjacent to the first developing roller and in facing relationship to the image carrier, the second developing roller receiving the developer composition from the first developing roller and supplying the developer composition to the image carrier; and a developer feed regulator comprises means for selectively moving the second developing roller toward and away from the first developing roller for varying a spacing between the first and second developing rollers.

* * * * *